United States Patent [19]

Ono et al.

[11] 4,047,361

[45] Sept. 13, 1977

[54] WRAPPING PAPER SUPPLYING DEVICE IN COIN WRAPPING APPARATUS

[75] Inventors: Masato Ono; Minoru Nakamura, both of Himeji, Japan

[73] Assignee: Glory Kogyo Kabushiki Kaisha, Japan

[21] Appl. No.: 733,192

[22] Filed: Oct. 18, 1976

[30] Foreign Application Priority Data

Oct. 17, 1975 Japan ..... 50-125034

[51] Int. Cl.[2] ..... B65B 11/04

[52] U.S. Cl. ..... 53/212; 53/389

[58] Field of Search ..... 53/212, 389

[56] References Cited

U.S. PATENT DOCUMENTS 3,899,864 8/1975 Uchida et al. ..... 53/389 X 3,950,921 4/1976 Itoda et al. ..... 53/212 X

*Primary Examiner*—Travis S. McGehee

*Attorney, Agent, or Firm*—Wenderoth, Lind & Ponack

[57] ABSTRACT

A wrapping paper supplying device used in a coin wrapping apparatus for wrapping stacks of coins of various denominations with paper comprises a pair of paper feeding rollers, a mechanism for interrupting the operation of the paper feeding rollers, a mechanism for setting the position of a cutter for obtaining a length of the paper suitable for wrapping the coins of a specific denomination, a cutter position detecting device operating the interrupting mechanism in accordance with the set position of the cutter, and a cam mechanism for varying the operational period of the interrupting mechanism depending on the cutter set position.

6 Claims, 12 Drawing Figures

III II I
224
223
28a
28b
227
228
28
27
28c
226
225

(A)
(B)
(C)
(D)
(E)
(F)
219a
219
220
216
215
6b
6a
217
214
214a
212
218
219b
219c
219d
I II III
28d

WRAPPING PAPER SUPPLYING DEVICE IN COIN WRAPPING APPARATUS

BACKGROUND OF THE INVENTION

This invention relates to a coin wrapping apparatus wherein a predetermined number of coins arranged in a stack is supported by coin supporting means, rotated in contact with a plurality of paper wrapping rollers, and wrapped with a piece of coin wrapping paper, the side edges of the paper being thereafter crimped at both ends of the thus wrapped coins by paper crimping means. The invention more particularly relates to a wrapping paper supplying device which supplies the wrapping paper between the coin stack and the plurality of paper wrapping rollers through a pair of paper supplying rollers.

In the conventional paper supplying devices of the above described kind, the paper feeding speed must be varied with the variation, in set position, of a cutter that cuts the wrapping paper into a suitable length. Such a requirement, however, invites disadvantageous features of necessitating the provision of a speed-regulating clutch, a cutter position detecting switch, and related parts, thus complicating the construction of the paper supplying device, increasing the possibility of failure, and giving rise to inaccuracy in the length of the cut wrapping paper.

SUMMARY OF THE INVENTION

With the above described disadvantageous features of the conventional wrapping paper supplying devices in view, a primary object of the present invention is to provide a wrapping paper supplying device which is simple in construction and economical in manufacture.

Another object of the present invention is to provide a wrapping paper supplying device wherein the operational period of the paper feeding rollers is regulated in accordance with the cutter set position, and thereby the leading end of the wrapping paper cut by the cutter is caused to arrive at the coin wrapping device at a predetermined time instant regardless of the setting of the cutter position, while an accurate length of the wrapping paper suitable for the wrapping of coins of a specific denomination can be supplied to the coin wrapping device.

These objects can be achieved by a wrapping paper supplying device incorporated in a coin wrapping apparatus wherein a predetermined number of coins are stacked, and a wrapping paper fed between a pair of paper feeding rollers and cut into a required length by a cutter is wound around the coin stack, the side edges of the paper then being crimped at both ends of the coin stack, the paper supplying device comprising: a mechanism for setting the cutter at a selected position corresponding to the denomination of the coins, means for supporting a feeding roller so that the latter is movable toward or away from the other, a cutter position detecting arm linked with the feed-roller supporting means, said arm being displaceable in accordance with the set position of the cutter, and control cam means contactable with an end of the cutter position detecting arm for a period determined by the set position of the cutter, whereby the operating period of the paper feeding rollers is varied depending on the set position of the cutter, and a time difference appropriate for the wrapping of coins is provided in the paper feeding operation of the paper feeding rollers.

In accordance with another aspect of the present invention, a wrapping paper supplying device of the above described type is so arranged that it comprises: a mechanism for setting the cutter at a position corresponding to the denomination of the stacked coins, means for supporting a feed roller so that it is movable toward or away from the other feed roller, a setting lever having a regulating surface located at a position determined by the set position of the cutter, rotatable cam means having peripheral parts differentiated in height air accordance with the denominations of the coins, an operative plate moved in contact with the cam means and engagable with the regulating surface of the setting lever, and a coupling member operated by the displacement of the setting lever to move the feed roller supporting means to control the operation of the paper feeding rollers, whereby the operating period of the paper feeding rollers is controlled by the abutting period of the operative plate against the regulating surface of the setting lever displaced in correspondence to the set position of the cutter.

The nature, principle, and the utility of the present invention will be more clearly understood from the following detailed description of the invention when read in conjunction with the accompanying drawings, wherein like parts are designated by like reference numerals and characters.

DETAILED DESCRIPTION

Figure 1:
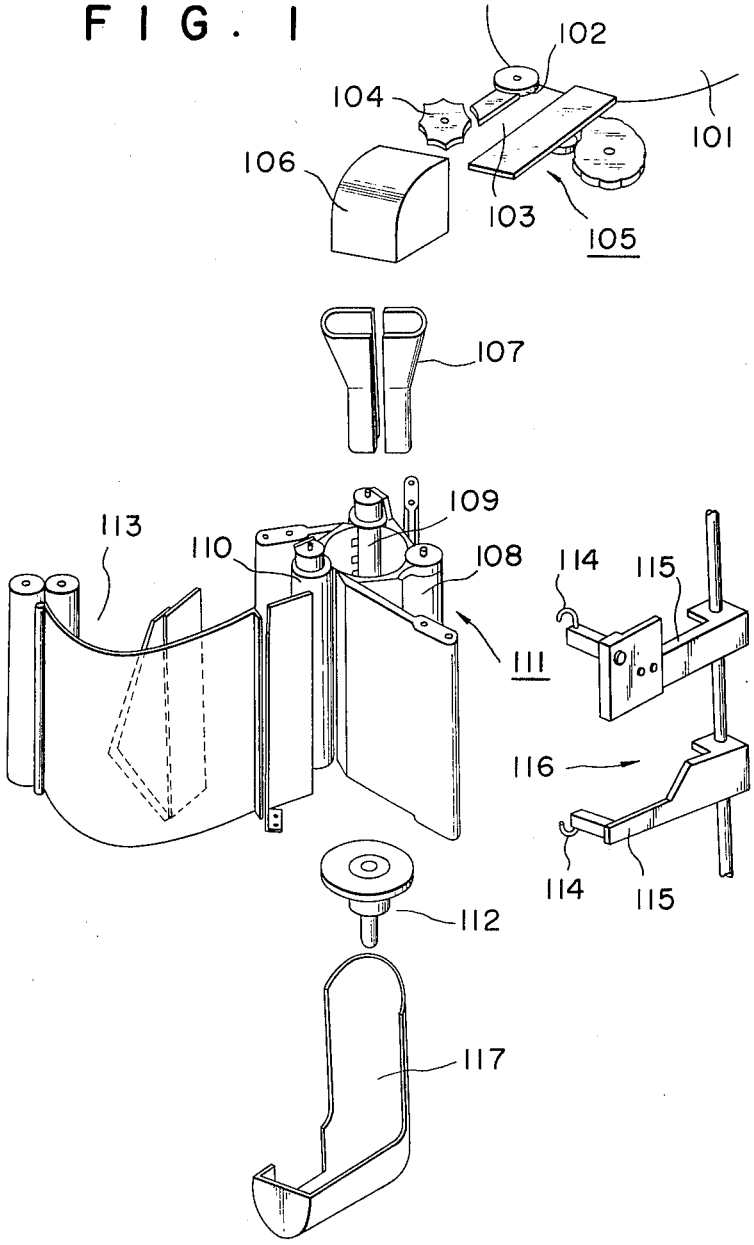
FIG. 1 is an exploded perspective view of a coin wrapping apparatus wherein the wrapping paper supplying device according to this invention is incorporated.

Before entering into a detailed description of the embodiments of the present invention, an outline of a coin wrapping apparatus wherein the wrapping paper supplying device of this invention is incorporated will be briefly described with reference to FIG. 1 as conducive to full understanding of this invention.

The coin wrapping apparatus comprises a coin feeding device 105 wherein coins dropped onto a turntable 101 are aligned along the periphery of the turntable 101 under application of centrifugal force. The coins thus aligned are sent out from the turntable 101 successively toward a gate 102 provided along the periphery of the turntabl , and then into a coin passage 103. The coins passing through the coin passage 103 are counted by a coin counting mechanism.

Coin guiding members 106 and 107 then guide the coins into a space surrounded by three coin wrapping rollers 108, 109, and 110 of a coin wrapping device 111. The coins introduced into the space in the form of a stack are supported by a coin supporting means 112, and rotated by the three rollers around the axis of the coin stack. A wrapping paper supplying device 113 of this invention supplies wrapping paper along the circumference of the stack of coins. A fold crimping device 116 including arms, each having a crimping hook 114, crimps the outwardly projecting side edges of the paper now wrapping around the coin stack at the upper and lower ends of the stack. The coin stack thus wrapped and crimped is then delivered through a coin delivering chute 117.

An example of the wrapping paper supplying device, according to the present invention, will now be described with reference to FIGS. 2, 3, 4(*a*), and 4(*b*). The paper supplying device comprises a pair of feed rollers 6, between which coin wrapping paper 1 is supplied into the coin wrapping device 2 having three coin wrapping rollers 4, which correspond to the wrapping rollers 108, 109, and 110 in the apparatus shown in FIG. 1, and a paper cutter 5 which cuts the paper under a tension applied thereto as the paper is guided between the three rollers 4 and a stack of coins C.

The cutter 5 has a chevron-shaped cutting blade at the working end thereof, and the body of the cutter 5 is secured to a cutter position setting arm 9 fixed to a shaft 8 rotatably supported by a platform structure 7 of the apparatus. Thus, the cutter 5 is movable together with the cutter position setting arm 9 toward or away from the paper feeding rollers 6. At one end of the cutter position setting arm 9, there is provided an engagement device engageable with cutter position setting holes 10, 11, and 12 which are provided through the platform structure 7.

In this embodiment of the invention, the aforementioned cutter position setting holes 10, 11, and 12, which are respectively positioned at a nearest position, a medium position, and a furthest position relative to the paper feed rollers 6, correspond to the positions at which the cutter is to be set in the cases of wrapping coins of a large diameter, a medium diameter, and a small diameter, respectively. In any of the above cases, the distance from the coin wrapping device 2 to the cutter 5 set through the above described procedure determines the length of the coin wrapping paper.

The above described engaging device provided at an end of the cutter position setting arm 9 includes an engagement pin 14 having an enlarged head portion 13 and a compression spring 15 inserted between the arm 9 and the pin 14. By pulling the pin 14 upward, moving the arm 9 to any of the positions of the holes 10, 11, and 12, and allowing the pin 14 to slip into one of the holes, the arm 9 and therefore the cutter 5 are set at the selected position.

The paper feeding rollers 6 comprise a driving roller 6*a* and a driven roller 6*b* movable toward or away from the driving roller 6*a.* The driven roller 6*b* is supported rotatably by a roller supporting lever 17 swingable about a shaft 16, at a position apart from the shaft 16. A guide plate 18 is secured to the roller supporting lever 17 for guiding the wrapping paper 1 between the two rollers 6*a* and 6*b.*

In the neighborhood of the paper feeding rollers 6, a vertical shaft 19 is provided, and a wrapping paper guide plate 20 consisting of a transparent material and extending in a curved manner such that the positional variation of the cutter 5 is thereby allowed is secured to the vertical shaft 19. Furthermore, an arm 21 swingable in synchronism with the swinging movement of the guide plate 20 is secured to the vertical shaft 19. To the aforementioned shaft 16 supporting rotatably the lever 17, a driven arm 22 having an arcuate surface engageable with an end of the arm 21 is secured. A tension spring 23 is extended between the arm 21 and the driven arm 22 thereby to constantly urge the driven roller 6*b* toward the driving roller 6*a.*

A cutter position detection arm 24 is pivotally connected to the other end of the roller supporting lever 17, and an intermediate point of the arm 24 is coupled through a connecting lever 24*a* to an intermediate point of the cutter position setting arm 9. At one end of the cutter position detection arm 24, there are provided two contact parts 25 and 26, having rollers, spaced apart from each other end disposed in opposition to the peripheral surface of a control cam 28 rotatable around a cam axis 27. When either of the two contact parts 25 and 26 is brought into abutment with a projecting part 29 of the cam 28, the cutter position detecting arm 24 is depressed so that the lever 17 supporting the driven roller 6*b* is rotated in the counter-clockwise direction as viewed in FIG. 2.

The positional relations of the two contacting parts 25 and 26 and the cam 28 are such that there are provided a first position I (for greater diameter coins) wherein neither of the contact parts 25 and 26 are allowed to contact with the projecting part 29 of the cam 28, a second position II (for medium size coins) where only one of the contact parts is brought into contact with the projecting part 29 of the cam 28, and a third position III (for smaller coins) where both parts 25 and 26 are in contact with the projecting parts 29 of the cam 28.

In the first position I, the arm 24 is not moved by the cam 28; in the second position, the driven roller 6*b* is separated from the driving roller 6*a* while one of the contacting parts 25 and 26 is depressed by the projecting part 29 of the cam 28; and in the third position III, the driven roller 6*b* is separated from the driving roller 6*a* for a period corresponding to the sum of the angular span of the projecting part 29 of the cam 28 and the distance between the two contacting parts 25 and 26.

In this embodiment of the invention, the other end of the cutter position setting arm 9 is coupled to a link 31 through a lever 30. The link 31 has a slot 32 into which is loosely inserted a pin 34 provided at one end of a vertically extending part of an L-shaped lever 33 which is swingably supported by the platform structure 7 of the apparatus. A roller 35 at the other end of the swingable lever 33 is brought into engagement with a clutch plate 37 having a circumferential groove and freely slidable along a shaft 36.

Upwardly from the clutch plate 37, a low-speed gear 38 for reducing the rotational speed of a turntable (not shown) and a belt (not shown) that vary the feeding rate of the coin supplying device, is loosely mounted on the shaft 36, and downwardly from the clutch plate 37, a high-speed gear 39 for elevating the rotational speed of the same turntable and belt is loosely mounted on the shaft 36, and either on of the gears 38 and 39 is coupled through a transmission device (not shown) to the turntable and the left in the coin supplying device. The aforementioned swingable lever 33 is urged by a spring 40 to swing in the direction to cause the plate 37 to mesh with the high-speed gear 39.

The operation of this example of the wrapping paper supplying device of the above described construction according to this invention is described below.

In the case of wrapping coins of a greater diameter, the engagement pin 14 at an end of the cutter position setting arm 9 is pulled up, as shown in FIG. 4(B), and the arm 9 is swung to a position where the pin 14 is aligned with the cutter position setting hole 10 for coins of greater diameter, the pin 14 is then being inserted into engagement with the hole 10. Thus, the cutter 5 is swung by the cutter position setting arm 9 and set for producing a greater length of the wrapping paper suitable for wrapping coins having a greater diameter. Simultaneously, the cutter position detecting arm 24 is depressed through the connecting lever **24*a* so that the contact parts 25 and 26 are moved to the first position I where the projecting part 29 of the cam 28 contacts neither of the contact parts 25 and 26 during the rotation of the cam 28, and the driven roller 6*b* is kept in contact with the driving roller 6*a***.

The wrapping paper 1 is thus forced against the blade part of the cutter 5 under a tension caused by the forward end of the paper being caught between the paper wrapping rollers 4 and the stack of coins C. While the stack of coins is wrapped by the paper 1 thus cut into a length adapted to the stack of coins of greater diameter, and the projecting side edges of the wrapping paper are then crimped, the succeeding part of the wrapping paper 1 is constantly fed by the operation of the paper feeding rollers **6*a* and 6*b* until the forward end thereof is again caught between the paper wrapping rollers 4 and the succeeding stack of coins guided into the paper wrapping position between the paper wrapping rollers 4**.

Figures 2, 4:
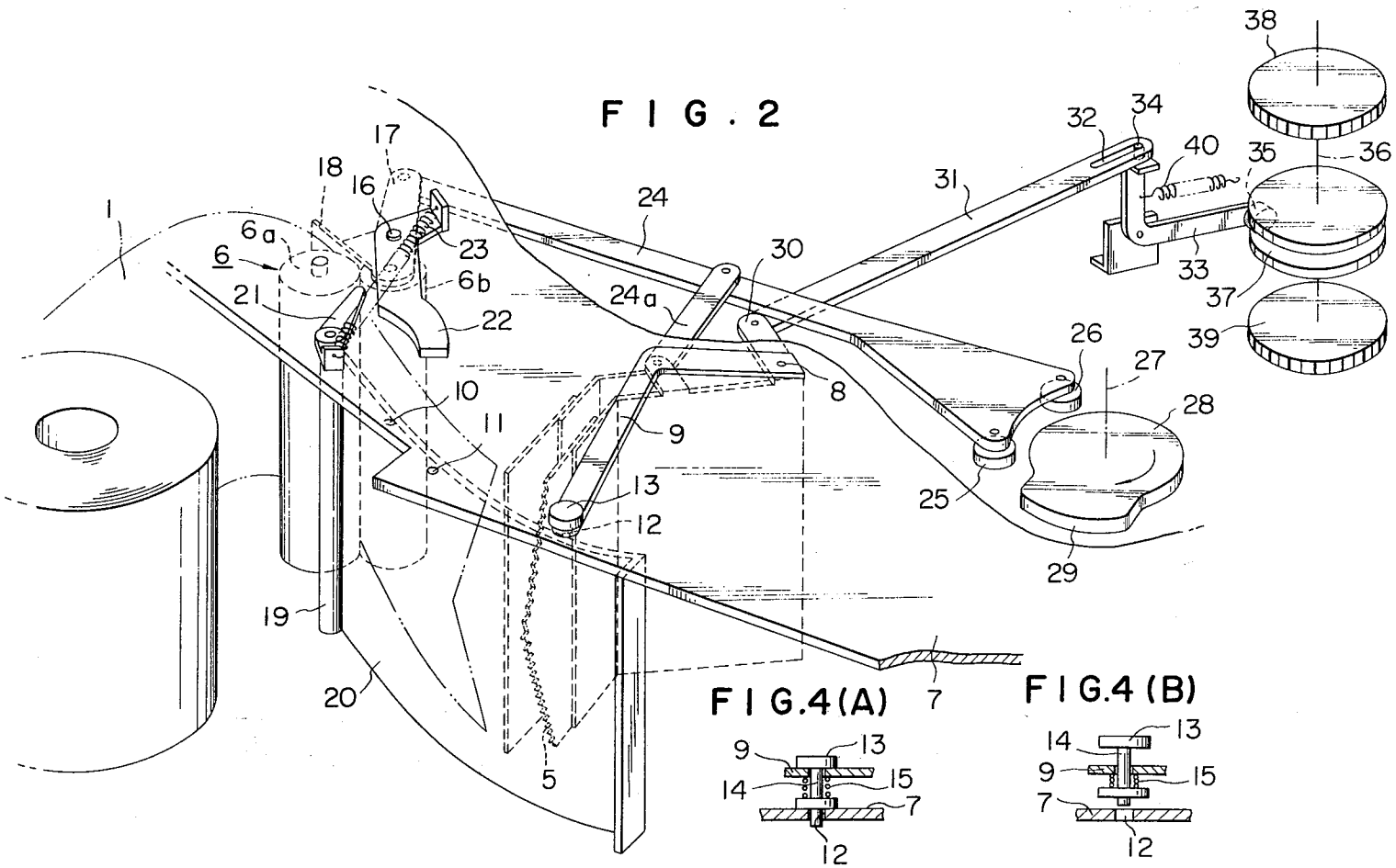
FIG. 2 is a perspective view of an embodiment of the present invention.
FIGS. 4(*a*) and 4(*b*) are sectional views showing the arrangement of a cutter position setting arm and a pin for setting the same.
Figure 3:
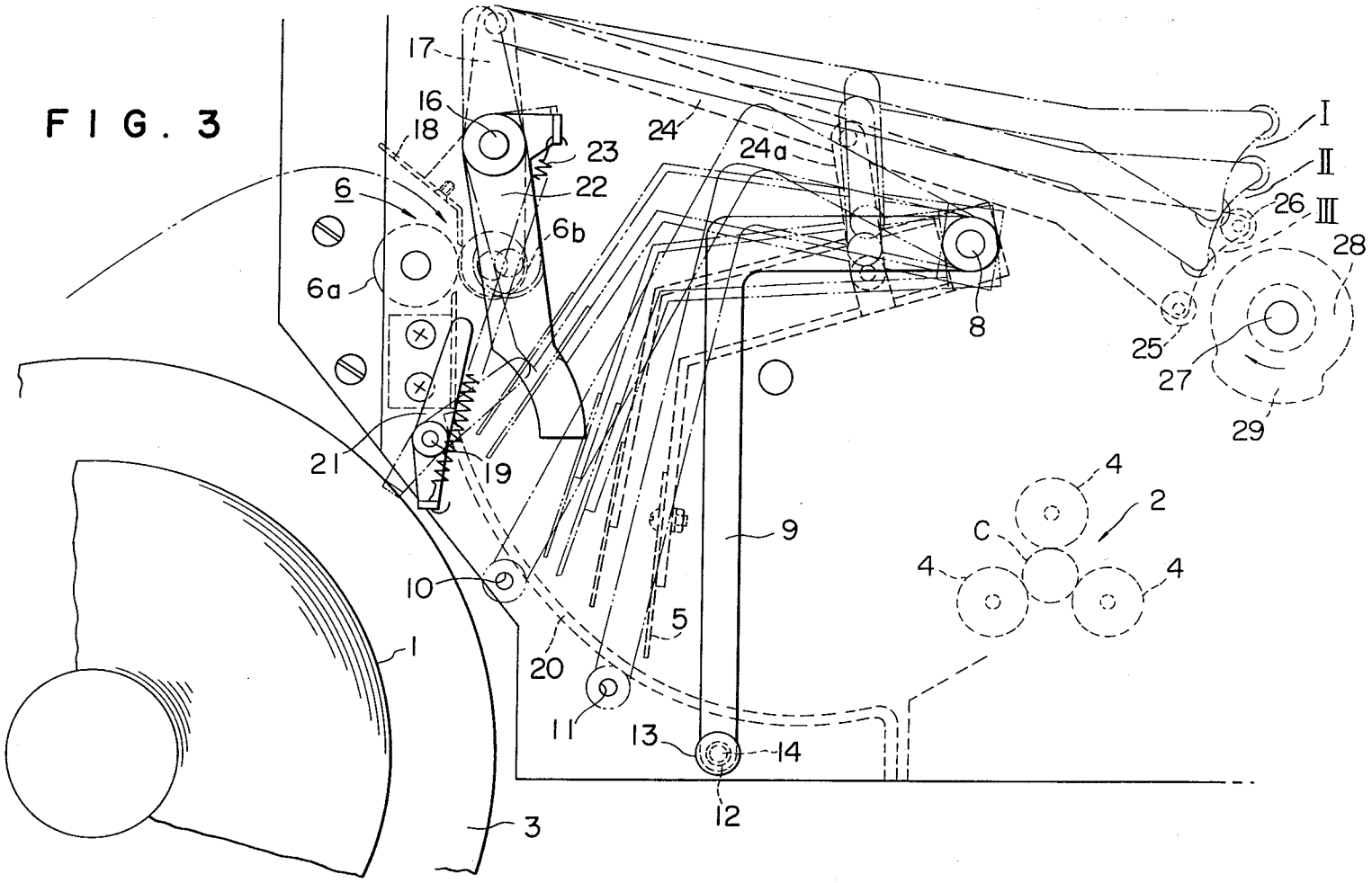
FIG. 3 is a plan view of the embodiment shown in FIG. 2.

During this time, the link 31 is moved through the connecting lever 30, thereby swinging the arm 33 under the force of the spring 40 in the counterclockwise direction as viewed in FIG. 2, thereby moving the clutch plates 37 downwardly to mesh with the high-speed gear 39, since the swingable arm 33 cannot be swung further than the position where the clutch 37 meshes with the high-speed gear 39, the pin 34 is positioned at one end of the slot 32.

It should be noted that when the wrapping paper 1 is initially introduced between the paper feeding rollers **6*a* and 6*b*, the guide plate 20 is swung in the forward direction. Thus, the arm 21 secured to the shaft 19 is rotated clockwisely, as viewed in FIG. 2, thereby to be brought into engagement with the arcuate part of the arm 22 secured to the shaft 16 and to rotate the arm 22 in the counterclockwise direction. The driven roller 6*b* is thus separated from the driving roller 6*a* to be kept in the separated state, and the wrapping paper 1 can be introduced into the coin wrapping device 2** without being hampered by the paper feeding rollers.

In the wrapping of coins of a medium diameter, the engagement pin 14 at the end of the cutter position setting arm 9 is brought into engagement with the hole 11. During the setting operation, the arm 9 is swung around the pivotal position 8, and the swinging movement is transmitted through the connecting lever **27*a* to the cutter position detecting arm 24 so that the arm 24 is moved to the second setting position II where only the contact part 25 at the end of the arm 24 contacts the projecting part 29 of the cam 28. In this case, the link 31 is also moved, but the movement causes only a sliding movement of the pin 34 of the swingable lever 33 within the slot 32 without causing any movement of the swingable arm 33, and the clutch plate 37 is kept in engagement with the high-speed gear 39**.

After the setting of the cutter position setting arm 9 at the second setting position II, coins C are introduced into the coin wrapping device 2, and the leading end of the wrapping paper 1 is caught between the coin wrapping rollers and the stack of coins in the coin wrapping device 2. Thus, a tension is applied to the wrapping paper 1, so that the paper 1 is cut into a length adapted for the wrapping of the medium size coin stack by the cutter 5, and wound around the circumference of the coin stack.

Simultaneously with the cutting operation, the projecting part 29 of the control cam 28 rotatable around the cam axis 27 abuts against the contact part 25 and depresses the same backward. The feed-roller supporting lever 17 is thus rotated in the counterclockwise direction as viewed in FIG. 2, thereby separating the driven roller **6*b* from the driving roller 6*a* and stopping the supply of the wrapping paper 1**.

When the projecting part 29 of the cam 28 passes through the contact part 25 of the cutter position detecting arm 24, the arm 24 is brought back to its initial position by the tension spring 23, and the driven roller **6*b* is caused to contact the driving roller 6*a*, whereby the feeding operation of the wrapping paper 1 is resumed. In other words, the feeding period of the wrapping paper 1** is shortened by the separated period of the paper feeding rollers.

In the case where a stack of coins having a smaller diameter is to be wrapped by the paper 1, the setting position of engagement pin 14 is changed to the third setting position III, and the pin 14 is inserted into the setting hole 12. As a result of the swinging movement of the cutter position setting arm 9, the cutter position detecting arm 24 is displaced forwardly through the connecting lever **24*a* so that the two contact parts 25 and 26 at the end of the arm 24 are allowed to contact the projecting part 29 of the control cam 28. In this case, the pin 34 at the end of the swingable lever 33 is pulled against the force of the spring 40 by the link 31 which is moved through the lever 30 by the cutter position setting arm 9, and is rotated in the counterclockwise direction thus causing the clutch plate 37 to be engaged with the low-speed gear 38**.

In this state, the coin wrapping rollers 4 in the coin wrapping device 2 are rotated at a low speed, and when the leading end of the wrapping paper 1 is caught between the rollers 4 and the stack of coins C, the paper 1 is forced against the cutter 5 to be cut into a length adapted for wrapping the stack of coins of the smaller diameter.

Then the projecting part 29 of the control cam 28 abuts against the contact part 25 thereby pushing the detecting arm 24 rearwardly and separating the driven roller **6*b* from the driving roller 6*a* thereby to interrupt the feeding operation of the wrapping paper 1. At an instant when the contact part 25 is disengaged from the projecting part 29 of the cam 28**, the other contact part 26 engages the projecting part 29 of the cam 28, thus maintaining the displacement of the cutter position detecting arm 24 for the entire period.

Accordingly, the driven roller 6*b* is separated from the driving roller 6*a* for the entire period beginning with the contact between the contacting part 25 and the projecting part 29 of the cam 28 and ending with the separation of the contacting part 26 from the projecting part 29 of the cam 28. The period during which the driven roller 6*b* is separated from the driving roller 6*a* is elongaged by an amount required for feeding the wrapping paper from the previous position to the newly set position of the cutter 5.

In this embodiment of the present invention, the clutch for changing the feeding rate of the various parts of the coin feeding device is switched by utilizing the movement of the cutter position detecting arm 24, it will be apparent that these changes of the rates may be carried out by other means. Furthermore, although the control of the wrapping paper feeding device has been carried out in three positions in this embodiment of the invention, it is apparent that two or four positions may be used depending on the design of the paper supplying device.

Figure 5:
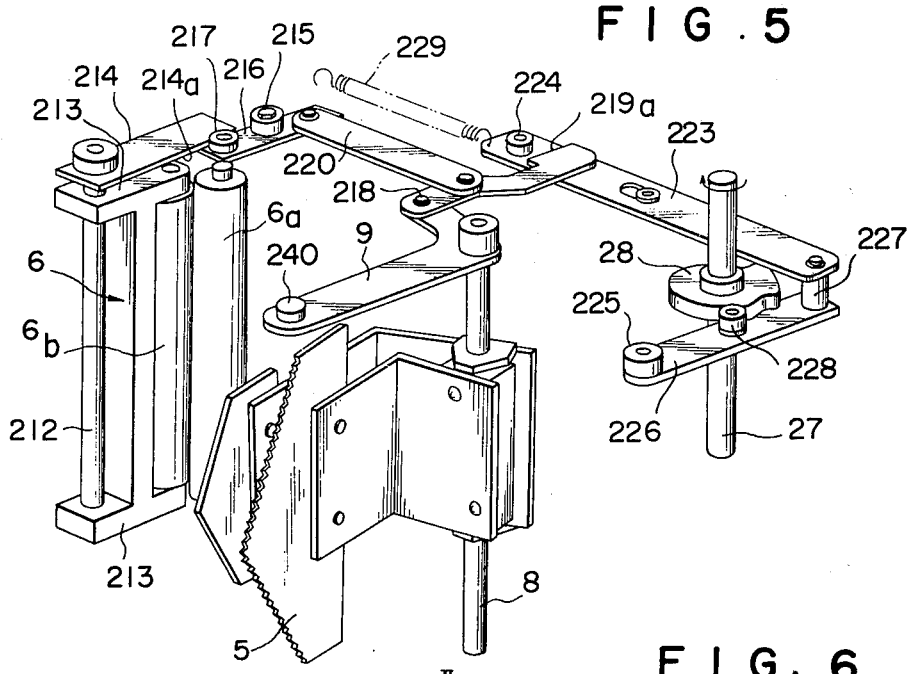
FIG. 5 is a perspective view showing another embodiment of the present invention.
Figure 6:
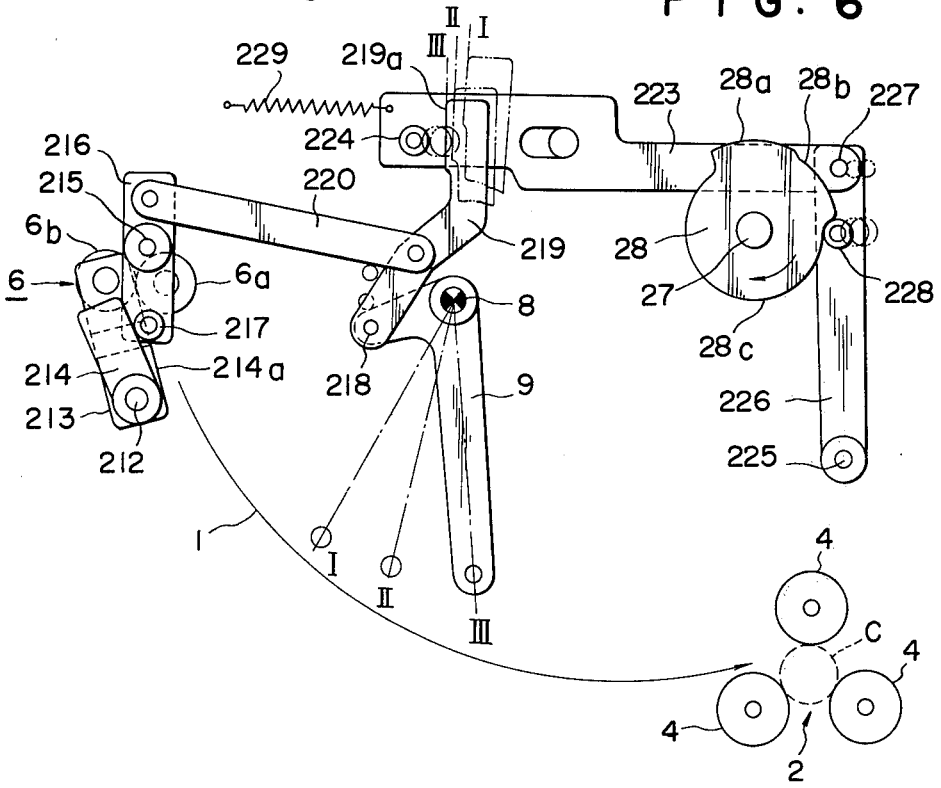
FIG. 6 is a plan view of the embodiment shown in FIG. 5.
Figures 7, 9:
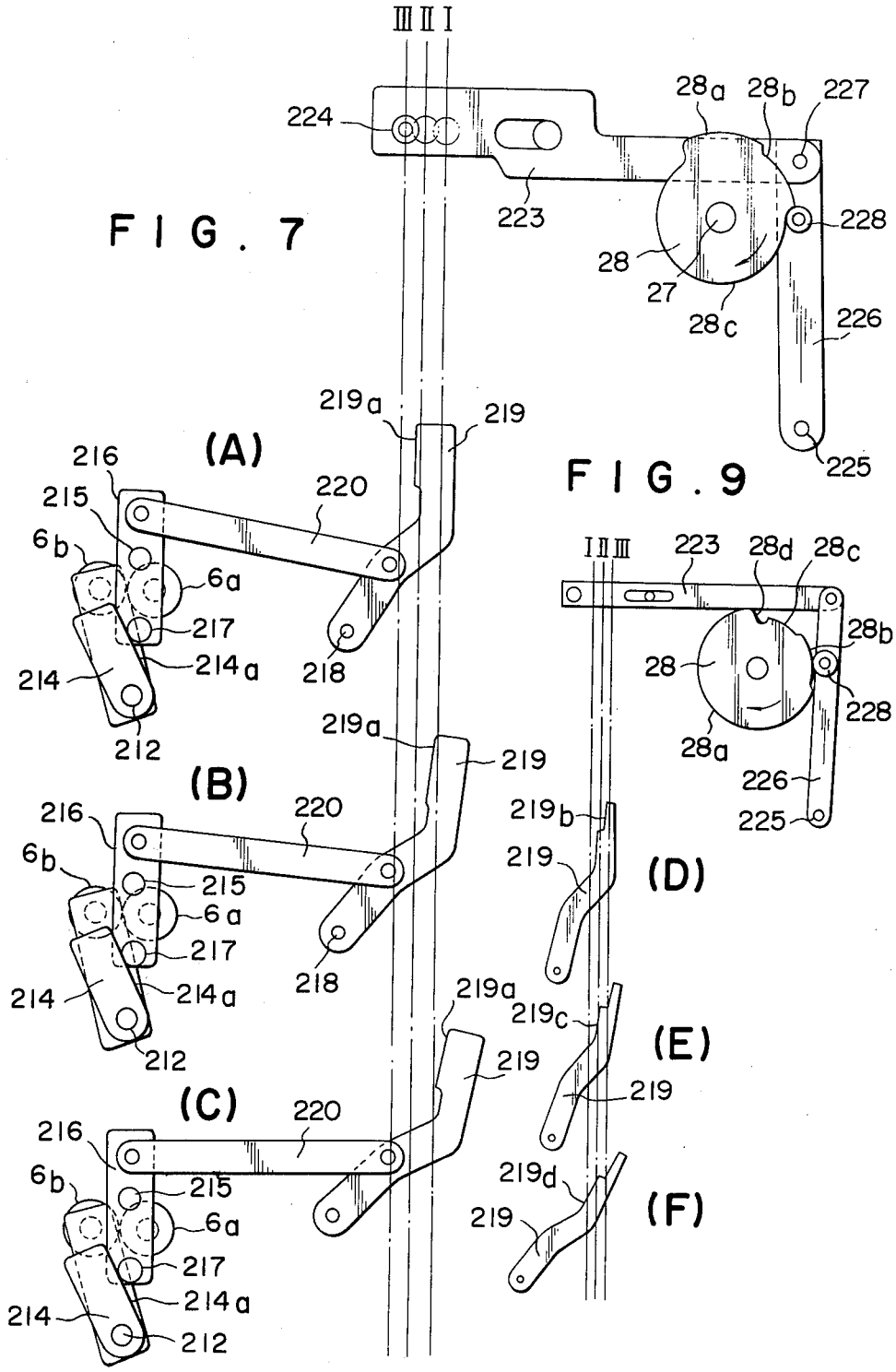
FIG. 7 is an explanatory diagram, in the form of a plan view, indicating the operation of the embodiment shown in FIG. 6, wherein (A) corresponds to the case of wrapping coins of small diameter, (B) corresponds to the case of wrapping coins of medium diameter, and (C) corresponds to that for coins of great diameter
FIG. 9 is an explanatory diagram, in the form of a plan view, indicating the operation of the embodiment shown in FIG. 8.

Referring now to FIGS. 5, 6, and 7, there is illustrated a wrapping paper supplying device constituting another embodiment of the present invention. Similarly as in the preceding embodiment of this invention, the paper supplying device constituting this embodiment comprises a pair of paper feeding rollers 6 through which coin wrapping paper 1 is supplied into the coin wrapping device 2 and a paper cutter 5 for cutting the paper under tension applied thereto as the leading end of the paper 1 is caught between the coin wrapping rollers 4 of the coin wrapping device 2 and a stack of coins received in the same device 2.

The cutter 5 has a chevron-shaped cutting blade at one end thereof, and the body of the cutter 5 is secured in a manner such that it is movable unitarily with a cutter position setting arm 9 secured to a shaft 8 rotatably supported by a structural frame (not shown) of the paper supplying device. At one end of the cutter position setting arm 9. There is provided an engagement device (FIGS. 10(G) and 10(H)) adapted to constitute a cutter position setting mechanism.

In this example, three cutter setting positions I, II, and III are provided in this order between the paper feeding rollers 6 and the coins wrapping device 2 for wrapping coins of a larger diameter, medium diameter, and a smaller diameter, respectively. The distance from the coin wrapping device 2 to the cutter position set by the cutter position setting arm 9 at any of the three positions I, II, and III corresponds to the length of the wrapping paper adapted for wrapping the coins of the diameter for which the position of the cutter is set.

The paper feeding rollers 6 comprises a driving roller 6*a* and a driven roller 6*b*, the latter roller 6*b* being rotatably supported by a roller supporting member 213 which is fixedly mounted on a shaft 212 extending in parallel with the driven roller 6*b* with a spaced apart relation. A spring (not shown) urges the roller supporting member 213 in a direction to cause the driven roller 6*b* to contact the driving roller 6*a*.

A cam lever 214 is fixed in an integral manner to the shaft 212, and a roller 217 provided at one end of a swingable arm 216, swingably supported by a shaft 215 at the middle part of the arm 216, abuts against the cam surface 214*a* of the cam lever 214. The other end of the swingable arm 216 is connected through a link 220 to the middle part of a setting lever 219, one end of which is pivotally connected by a pin 218 with the other end of the aforementioned cutter position setting arm 9.

A roller 224 is provided at one end of an operative plate 223 which is reciprocated by a cam 28 on a camshaft constituting a driving system for timing various parts of the coin wrapping device, and this roller 224 is disposed in opposition to a regulating surface 219*a* formed at the other end of the setting lever 219. The other end of the operative plate 223 is pin-connected at 227 with an arm 226 swingable around a pin 225 and having a roller 228 at a middle part of the arm 226, the roller 228 being forced into contact with the cam surface of the cam 28 as the operative plate 223 is urged rearward (leftward as viewed in FIG. 5) under the force of a tension spring 229.

The peripheral cam surface of the cam 28 has a high step portion 28*a*, a medium step portion 28*b*, and a low step portion 28*c*.

When the cutter position setting arm 9 is set at the third setting position III for smaller size coins, the regulating surface 219*a* of the setting 219 is at the third position of the same surface. Likewise when the cutter position setting arm 9 is set at the second setting position II or the first setting position I for medium size coins or larger size coins, respectively, the regulating surface 219*a* of the setting lever 219 is placed at the second or first position of the same surface.

Accordingly, when the cutter position setting arm 9 is set at the third position III or the second position II, the regulating surface 219*a* of the setting lever 219 comes in contact with the roller 224 on the operative plate 223 while the plate 223 is moved rightward, as viewed in FIG. 6, by both the greater radius portion 28*a* and the medium radius portion 28*b* of the cam 28, or by only the high step portion 28*a* of the same cam 28. But when the cutter position setting arm 9 is set at the first position I for the greater size coins, the regulating surface 219*a* of the setting lever 219 does not come in contact with the roller 224 on the operative plate 223 regardless of the movement of the operative plate 223.

Figure 10G:
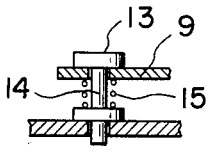
FIGS. 10(G) and 10(H) are sectional views showing an example of setting means of a cutter position setting arm.
Figure 10H:
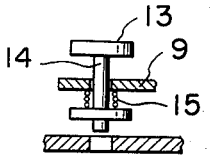

The aforementioned engagement device provided at one end of the cutter position setting arm 9 may be constructed as shown in FIGS. 10(G) and 10(H), wherein a pin 14 having an enlarged head 13 is provided to pass through a hole at an end of the arm 9, and a compression spring 15 is provided between a flange portion of the pin 14 and the arm 9. By pulling the pin 14 upward as shown in FIG. 10(H) against the spring force of the compression spring 15, the lower end of the pin 14 can be disengaged from a hole that may be provided in a structural member for setting the cutter position, and the arm 9 can be moved to another cutter setting position with another hole, provided in the same member, into which the lower end of the pin 14 can be inserted for setting the arm 9 and hence the cutter 5 to the new position as described hereinbefore.

The above described embodiment of the invention operates as follows.

First, when the cutter position setting arm 9 is set at the third position III for wrapping coins of a smaller diameter as shown in FIG. 6, the cutter 5 is moved around the shaft 8 to a position corresponding to the third position III, and the distance between the coin wrapping device 2 and the cutter 5 is made suitable for obtaining the length of the wrapping paper adapted for wrapping the stack of coins of the smaller diameter.

Simultaneously, the regulating surface 219*a* of the setting lever 219 is brought to the third position III of this surface (as shown in FIG. 7(A)) which is nearest of all the setting positions to the roller 224 on the operative plate 223.

In this state. the coin wrapping apparatus is operated, rotating the cam-shaft 27 in the clockwise direction. The high and medium step portions 28*a* and 28*b* of the cam 28 depress the roller 228 on the arm 226 rightwardly as viewed in FIG. 6. The arm 226 is thus rotated in the clockwise direction around the pin 225, shifting the operative plate 223 connected to the end of the arm 226 rightwardly. As a result, the roller 224 on the operative plate 223 abuts against the regulating surface 219*a* of the setting lever 219 rightwardly thereby rotating the setting lever 219 in the clockwise direction around the pin 218. Thus, through the connecting link 220, the swingable arm 216 is swung around the shaft 215 in the clockwise direction.

The roller 217 at the other end of the swingable arm 216 now depresses the cam surface 214*a* of the cam lever 214, rotating the same lever 214 in the counterclockwise direction around the axis of the shaft 212 formed integrally with the cam lever 214. The rotation of the shaft 212 separates the driven roller 6*b* from the driving roller 6*a*. From the above description, it will be apparent that the paper feeding operation of the paper supplying device of this invention is interrupted for period of corresponding to an angular range covering the higher step portion 28*a* and the medium step portion 28*b* of the cam 28.

When the roller 228 again comes into contact with the lower step portion 28*c* of the cam 28, the arm 226 is rotated in the counterclockwise direction, pushing the operative plate 223 leftward and separating the roller 224 from the regulating surface 219*a* of the setting lever 219. Thus, the setting lever 219 is retracted to the original portion, bringing the connecting link 220, swingable arm 216, and cam lever 214 all back to their original positions, and bringing the driven roller 6*b* into contact with the driving roller 6*a* for resuming the paper feeding operation. In the case of wrapping coins of a smaller diameter, the wrapping paper is fed for a period corresponding to the lower step portion 28*c* of the cam 28, and the length of the thus fed paper is sufficient for wrapping coins of the smaller diameter.

In the case of wrapping coins of a medium diameter, the cutter position setting arm 9 is set at the second position II. The cutter 5 is rotated to a position suitable for cutting the wrapping paper 1 into a length sufficient for wrapping the coins of the medium size.

Simultaneously, the regulating surface 219*a* of the setting lever 219 is displaced to the second position II of the reference surface, which is spaced apart from the roller 224 on the operative plate 223 by a distance corresponding to the height of the medium step portion 28*b* of the cam 28 relative to the low step portion 28*c*. This state is shown in FIG. 7(B).

After the above described setting of the cutter position setting arm 9 as well as the regulating surface 219*a* of the setting lever 219, the operation of the coin wrapping device is started. With the rotation of the cam shaft 27 is the arrow-marked direction, the medium step portion 28*b* of the cam 28 forces the foller 228 rightwardly, thus shifting the operative plate 223 rightwardly as viewed in FIG. 6. At this instant, although the roller 224 on the operative plate 223 comes into the close proximity of the regulating surface 219*a* of the setting lever 219, the roller 224 does not depress the regulating surface 219*a* of the setting lever 219.

When the high step portion 28*a* then shifts the roller 228 further rightwardly, the roller 224 on the operative plate 223 abuts against the regulating surface 219*a* of the setting lever 219 and rotates the latter clockwisely. Thus, the driven roller 6*b* is separated as in the case of the smaller diameter coins, and the paper feeding operation of the paper supplying device is interrupted for a period corresponding to the angular span of the high step portion 28*a* of the cam 28.

In the case where coins having a greater diameter are to be wrapped, the cutter position setting arm 9 is set at the first position I corresponding to the greater size coins, where a length of the wrapping paper adapted for wrapping the greater size coins is cut from the wrapping paper 1 as described hereinbefore. Simultaneously, the setting lever 219 is displaced to the first position I thereof, where the regulating surface 219*a* is separated from the roller 224 on the operative plate 223 by a distance greater than that corresponding to the high step portion 28*a* of the cam 28. This state is indicated in FIG. 7(C).

In this state, alghough the coin wrapping apparatus is operated, the cam 28 rotating in the arrow-marked direction and the medium step and the high step portions 28*b* and 28*a* of the cam 28 shifting the operative plate 223 rightwardly as described above, the roller 224 on the operative plate 223 does not abut against the regulating surface 219*a* of the setting lever 219, thus causing no swinging movement of the lever 219. Accordingly, the driven roller 6*b* is held in contact with the driving roller 6*a* without interrupting the feeding operation of the wrapping paper 1, so that a length of the wrapping paper sufficient for wrapping the greater size coins can be positively obtained.

Figure 8:
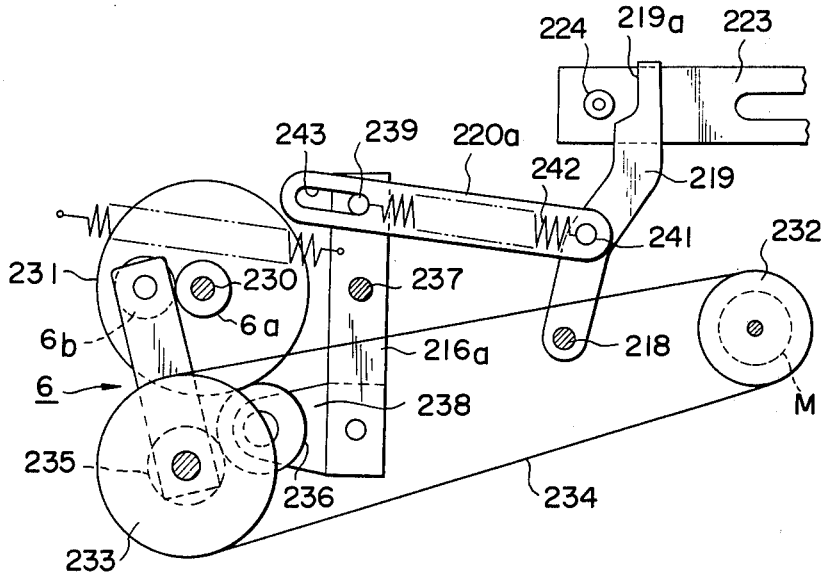
FIG. 8 is a plan view showing still another embodiment of the present invention.

In FIG. 8, there is illustrated still another embodiment of the present invention wherein a clutch mechanism is interposed between the driving roller 6*a* of the paper feeding device 6 and the driving system of the apparatus for the purpose of controlling the feeding rate of the wrapping paper.

More specifically, a frictional power transmission roller 231 is fixedly mounted on the shaft 230 of the driving roller 6*a*, while another frictional roller 235 is driven through an endless belt 234 stretched over pulleys 232 and 233, by a motor M. An intermediate frictional roller 236 slidably contacting both frictional rollers 231 and 235, is rotatably mounted on a bracket 238 extending transversably from one end of an arm 216*a* which is swingable around a pin 237. At the other end of the arm 216*a*, there is provided a pin 239 projecting therefrom and inserted into a slot 243 formed at one end of a link 220*a*, the other end of which is pivotally connected with a setting lever 219 through a pin 241. A tension spring 242 is provided between the pin 239 on the arm 216*a* and the pivotal pin 241 on the setting lever 219.

The setting lever has a regulating surface 219*a* which is subdivided into regulating surfaces 219*b*, 219*c*, and 219*d* corresponding to coins having a smaller diameter, a medium diameter and a greater diameter as indicated at (D), (E), (F) in FIG. 9. A cam 28 is provided, as in the previous example, to cooperate with a roller 228 on an arm 226 which is swingable around a pin 225 at one end of the arm 226. The other end of the arm 226 is pin-connected to an operative lever 223 identical with that in the previous embodiment of this invention.

Differing from that in the previous embodiment, the cam 28 has a low step portion 28*c* for coins having a smaller diameter, a medium step portion 28*b* for coins having a medium diameter, a high step portion 28*a* for coins having a greater diameter, and further has a cutoff portion 28*d* for defining a starting position of the cam operation.

At the time when coins having a smaller diameter are to be wrapped in the coin wrapping apparatus, the regulating surface 219*b* for small coins on the setting lever 219 is placed at a position indicated at (D) in FIG. 9. Likewise, when coins having a medium diameter are to be wrapped, the regulating surface 219*c* for medium coins is placed at a position indicated at (E) in FIG. 9, and when coins having a greater diameter are to be wrapped, the regulating surface 219*d* is placed at a position indicated at (F) in FIG. 9.

In the first case where smaller diameter coins are to be wrapped, the roller 224 on the operative place 223 does not abut against the regulating surface 219*d* of the setting lever 219 while the roller 228 is in contact with the medium step portion 28*b* or the low step portion 28*c* of the cam 28 during the rotation of the latter, but the roller 224 is brought into contact against the regulating surface 219*b* when the roller 228 rides onto the high step portion 28*a* of the cam 28.

Thus, the setting lever 219 swings arond the pin 218 in the clockwise direction as viewed in FIG. 8, swinging the swingable arm 216*a* in the clockwise direction through the tension spring 242. The intermediate frictional roller 236 is now brought into contact with the frictional rollers 231 and 235 simultaneously and operates as an idler which transmits the driving power of the roller 235 to the roller 231 and then to the paper feeding roller 6*a.* As a result, the wrapping paper 1 is fed between the paper feeding rollers 6*a* and 6*b* toward the coin wrapping device in this apparatus only while the high step portion 28*a* is in contact with the roller 228.

In the case where medium diameter coins are to be wrapped, the clutch mechanism comprising the frictional rollers 213, 235, and 236 is brought into an ON state wherein the roller 228 contacts the medium step portion 28*b* and the high step portion 28*a* of the cam 28, and in the case where greater diameter coins are to be wrapped, the clutch mechanism is kept in the ON state throughout three portions 28*a,* 28*b,* and 28*c* of the cam 28.

Althouth the paper supplying device of the invention has been described above as being capable of handling three kinds of coins, namely, of a smaller diameter, a medium diameter, and a greater diameter, it is apparent that the number of kinds of the coins can be increased as necessary by increasing the number of step portions on the periphery of the cam 28.

According to the present invention as described hereinabove, there is provided a wrapping paper supplying device wherein the difference in the feeding distance of the wrapping paper, that is the difference in the position of the leading end of the wrapping paper, caused by the change in position of the cutter set in accordance with the denomination of the coins to be wrapped by the wrapping paper, is compensated for by the time difference provided in the operation of the feeding rollers, that is, by separating the feeding rollers for a period differentiated in accordance with the denomination of the coins. Accordingly, the necessity of varying the rotating speed of the feeding rollers according to the kind of the coins as in the conventional device can be eliminated, and switches and other operational mechanisms for controlling the operation of the feeding rollers can be thereby omitted.

We claim:

1. A wrapping paper supplying device incorporated in a coin wrapping apparatus wherein a predetermined number of coins are stacked together and wrapped by a piece of wrapping paper fed through a pair of paper feeding rollers and cut by a cutter into said piece of a length adapted for the coins, the paper thus wrapped being thereafter crimped at projecting sides edges thereof at the ends of the coin stack, the paper supplying device comprising: a cutter position setting mechanism for setting the cutter at one of the positions adapted for cutting the paper into said piece of said length appropriate for wrapping the coins of a specific denomination; roller supporting means for supporting one of the feeding rollers in a manner such that one of the rollers is movable toward or away from the other; a cutter position detecting arm which is coupled with said roller supporting means and is displaceable in accordance with the set position of said cutter; and control cam means operating cooperatively with a contact part of said detecting arm for displacing the detecting arm for a period determined by the set position of said cutter, whereby the operative period of the paper feeding rollers is varied depending on the set position of said cutter, and thereby a time-difference appropriate for the wrapping of the coins is provided in the paper feeding operation of the feeding rollers.

2. A wrapping paper supplying device as set forth in claim 1 wherein said cutter position setting mechanism comprises a cutter position setting arm and an engagement pin provided at one end of the cutter position setting arm for engagement in any one if a plurality of cutter position setting holes provided in the structure of the wrapping paper supplying device.

3. A wrapping paper supplying device as set forth in claim 1 wherein said control cam means comprises a cam member continually rotated around its axis and having portions contactable by said contacting part of the said cutter position detecting arm displaced in accordance with the set position of said cutter.

4. A wrapping paper supplying device incorporated in a coin wrapping apparatus wherein a stack of coins are wrapped by a piece of wrapping paper fed through a pair of paper feeding rollers and cut by a cutter into said piece of a length adapted for wrapping the coins, the paper thus wrapped being thereafter crimped at projecting side edges thereof at the ends of the coin stack, the paper supplying device comprising: a cutter position setting mechanism for setting the cutter at one of the positions adapted for cutting the paper into said piece of said length appropriate for wrapping coins of a specific denomination; roller supporting means for supporting one of the feeding rollers so that it is movable toward or away from the other; a setting lever having a regulating surface at a position determined by the set position of said cutter; rotatable cam means having peripheral parts differential in height in accordance with the denominations of the coins; an operative plate moved in contact with the cam means and engageable with the regulating surface of the setting lever; and a coupling member operated by the displacement of the setting lever to move the feed roller supporting means for controlling the operation of the feeding rollers, whereby the operation period of the paper feeding rollers is controlled by the contacting period of the operative plate against the regulating surface of the setting lever displaced in accordance with the set position of said cutter.

5. A wrapping paper supplying device incorporated in a coin wrapping apparatus wherein a stack of coins are wrapped by a piece of wrapping paper fed through a pair of paper feeding rollers and by a cutter cut into said piece of a length adapted for wrapping the coins, the paper thus wrapped being thereafter crimped at projecting side edges thereof at the ends of the coin stack, the paper supplying device comprising; a cutter position setting mechanism for setting the cutter at one of the positions adapted for cutting the paper into said piece of said length appropriate for wrapping coins of a specific denomination; a clutch mechanism interposed between one of the feeding rollers and a driving power source of the device; a setting lever having a regulating surface at a position determined by the set position of the cutter; rotatable cam means having peripheral parts differentiated in height in accordance with the denominations of the coins; an operative plate moved in contact with the cam means and engageable with the regulating surface of the setting lever; and a coupling member for transmitting the displacement of the setting lever to the clutch mechanism, whereby the operation period of the paper feeding rollers is controlled by the contacting period of the operative plate against the regulating surface of the setting lever displaced in accordance with the set position of said cutter.

6. A wrapping paper supplying device as set forth in claim 5 wherein said clutch mechanism comprises a frictional roller concentric with said one of the feeding rollers, another frictional roller driven by a motor, and an idle roller supported by swingable lever which is operated through said coupling member by said setting lever.

* * * * *